US007140399B2

(12) United States Patent
Bruske et al.

(10) Patent No.: US 7,140,399 B2
(45) Date of Patent: Nov. 28, 2006

(54) SHAFT DRIVE SYSTEM FOR POWER LOOM SHAFTS

(75) Inventors: Johannes Bruske, Albstadt (DE); Bernhard Münster, Messtetten (DE); Armin Fäller, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 282 days.

(21) Appl. No.: 10/939,482

(22) Filed: Sep. 14, 2004

(65) Prior Publication Data

US 2005/0056334 A1 Mar. 17, 2005

(30) Foreign Application Priority Data

Sep. 17, 2003 (DE) ..... 103 43 377

(51) Int. Cl.
*D03D 51/00* (2006.01)
*D03D 51/18* (2006.01)
*D03C 13/00* (2006.01)

(52) U.S. Cl. ..... 139/55.1; 139/1 E; 139/66 A; 139/66 R; 139/455; 139/97

(58) Field of Classification Search ..... 139/1 E, 139/55.1, 76, 66 A, 59, 66 R, 82, 455, 97, 139/105, 106, 340, 349
See application file for complete search history.

(56) References Cited

U.S. PATENT DOCUMENTS 3,807,460 A * 4/1974 Alexandr et al. ..... 139/76
3,865,147 A * 2/1975 Lev et al. ..... 139/1 E
3,871,419 A * 3/1975 Pfarrwaller ..... 139/114
4,314,588 A * 2/1982 Speich ..... 139/79
4,444,225 A * 4/1984 Palau et al. ..... 139/66 R
4,905,738 A * 3/1990 Kleiner ..... 139/76
5,069,256 A * 12/1991 Goodman, Jr. ..... 139/83
5,653,268 A * 8/1997 Burkert ..... 139/79
5,908,050 A 6/1999 Froment et al.
5,918,645 A * 7/1999 Froment et al. ..... 139/66 R
7,017,617 B1 * 3/2006 Bassi et al. ..... 139/59
7,032,624 B1 * 4/2006 Bruske et al. ..... 139/57

FOREIGN PATENT DOCUMENTS

DE 697 02 039 T2 9/2000
EP 0851045 A 7/1998

* cited by examiner

*Primary Examiner*—Gary L. Welch
*Assistant Examiner*—Robert Muromoto
(74) *Attorney, Agent, or Firm*—Norman N. Kunitz; Fitch, Even, Tabin & Flannery

(57) ABSTRACT

A novel shaft gear for harmonious engagement and disengagement of individual heddle shafts and for deriving their motion from the rotary motion of a single input shaft has a coupling system with two input elements. While one of the input elements serves to drive the output element of the coupling system permanently, the other input element serves solely to synchronize the output element briefly with the first input element. The switchover takes place in the brief synchronous phases, in selected angular regions that correspond to the top or bottom reversal point of the heddle shaft. For the switchover, such novel shaft drive mechanisms do not require any stoppage of motion for the input shaft or the shaft drive mechanism.

21 Claims, 11 Drawing Sheets

SHAFT DRIVE SYSTEM FOR POWER LOOM SHAFTS

CROSS REFERENCE TO RELATED APPLICATION

This application claims the priority of German Patent Application No. 103 43 377.5, filed on Sep. 17, 2003, the subject matter of which, in its entirety, is incorporated herein by reference.

FIELD OF THE INVENTION

The invention relates to a shaft drive system for at least one heddle shaft of a power loom.

BACKGROUND OF THE INVENTION

For forming sheds, power looms are as a rule provided with a plurality of heddle shafts, each of which has many heddles, arranged parallel to one another, through whose the yarn eyelets the warp yarns are passed. For forming sheds, or shedding, the heddle shafts are moved very rapidly up and down. This is accomplished by shaft drive system, which are also called shaft looms or eccentric looms. So-called eccentric looms generate the up-and-down motion of the heddle shafts from the rotary motion of a drive shaft, and high weaving speeds are attainable. However, such eccentric looms are inflexible. Only to a limited extent is it possible to create patterns or different kinds of bindings. For this reason, shaft drive systems are extensively used in which a pawl coupling is provided between a drive shaft and the eccentric element, for generating the shaft motion.

One such shaft loom is known for instance from German patent disclosure DE 697 02 029 T2. The pawl indexing mechanism located between the eccentric element and the driving shaft is switched on here for each shaft motion—that is, for an upward motion or a downward motion of the shaft, in each case for one-half of one revolution of the shaft. Such shaft looms are very flexible. However, such shaft looms cannot attain the operating speed of eccentric looms. The function of the pawl indexing mechanisms is vulnerable to wear. Increasing the operating speed, however, not only causes pawl wear but also leads to breakage of heddles and shafts.

SUMMARY OF THE INVENTION

With the above as the point of departure, it is the object of the invention to create a shaft drive system for the heddle shaft of a power loom that makes a high operating speed possible, yet with little load on its elements and on the heddle shaft connected to it.

This object is attained with the shaft drive system of claim 1:

According to the invention, the shaft motion is defined such that neither a purely sinusoidally oscillating up-and-down motion of the shaft, nor an oscillating motion with stoppages at the top and bottom reversal points is obtained. Instead, not only during the phases of motion but also now during the resting phases of the shaft, phases in which the shaft otherwise typically stops at the top or bottom reversal point, the drive system compels a continuous motion of the shaft. This provision opens up the possibility of reducing the maximum accelerations of the shaft. Avoiding abrupt changes in acceleration leads to smooth running of the shafts, without jolting, and even at high operating speeds this does not induce excessive vibration. The operating speed limit at which shaft and heddle breakage occurs can thus be shifted very far toward higher operating speeds. The corresponding curves of motion to be executed by the shaft can be attained, in a first embodiment of the invention, by means of freely programmable drive systems that move the shaft. A control unit associated with the drive systems demand a high speed from the drive systems during the phases of motion, so as to shift the shaft from one reversal position to the other as fast as possible. This process is necessary for shedding, so as to move warp yarns upward or downward out of the warp yarn plane. Once the shaft nears its intended reversal position, the control unit slows down the shaft drive system power takeoff mechanism, which is formed by connecting rods, for instance, and then when the reversal position is reached allows it to swing back and forth around the reversal position in pendulum fashion. Depending on the dwell time in the reversal position, the pendulum motion can pass through one or more maximum and minimum points (undulation courses). The pendulum motion in the resting phases has the advantage that the shaft drive system can predetermine shaft motions that have lesser acceleration values. For instance, in its course over time, at the transition from one reversal position to another, the shaft motion obeys a harmonic function (sine or cosine), and at the reversal position changes over to a time function at the onset of which the acceleration has the same value as upon leaving the curve segment of the transitional motion. The course of acceleration is accordingly constant. The motion curves (also known as "motion principles") for the transition of the shaft from one reversal position to the other and for the pendulum motion within the reversal point regions can, in a simple embodiment, be stored in a data memory. The control unit then calls up the various control curves from the data memory and triggers the motor or motors of the shaft drive system accordingly. Alternatively, the control curves may be calculated either in advance or in real time; the calculation may be done, from one instance to another, in accordance with special optimization criteria, depending on given peripheral conditions. Examples of optimization criteria may be that a minimum shed opening time must not be less than a given minimum; that the maximum accelerations must be limited; that abrupt changes in acceleration are impermissible; that the shaft speed must be limited; or that for a given maximum acceleration, a maximum operating speed is calculated. The curves resulting from these optimization criteria can then be buffer-stored and used for triggering the shaft drive system. The pendulum motion of the shaft at the top and bottom reversal point region has the further advantage that by the pendulum motion of the heddle shaft, the tension on the warp yarns can be reduced somewhat, which can make the initial weft yarn course easier.

It is also possible for the motion to be executed by the shaft during the resting phase to be generated or predetermined mechanically. For instance, the shaft can be connected via a coupling system selectively to a first drive system, which generates a constant pendulum motion between the two reversal positions, or to another drive system, which generates the motion that swings back and forth about the top or the bottom reversal position. The switchover is preferably effected during existing synchronous phases. The corresponding coupling may be a coupling that transmits linear motions.

The shaft drive system of the invention may, in another embodiment, have an input shaft which is connected to a rotary drive mechanism and which in the final analysis serves to drive a gear system which generates the reciprocating motion of the heddle shaft. The coupling system provided between the input shaft and the gear system has at least two input elements and one output element, which is connected to the gear system. The input elements, upon pickup of the motion from inside, generate a synchronized motion, at least intermittently. Within these time slots in which there is synchronicity between the two input elements and in which the shaft is not at rest, the bell crank lever can switch over from one input element to the other. Thus the switchover is not perceptible as either a jolt or a shock in the drive train. It is therefore unnecessary to reduce the rotary speed of the input shaft for the switchover. An increased operating speed of the power loom can be attained without excessive wear or shaft or heddle breakage, even if individual heddle shafts have to be activated and deactivated again repeatedly.

In one embodiment of the shaft drive system, the first input element is a clutch disk which is solidly connected to the input shaft and thus executes a uniform rotary motion that is predetermined by the rotary drive mechanism. The second input element is then a clutch disk which executes a rotary/oscillatory motion. In selected angular regions that correspond to the top and bottom reversal points of the heddle shaft, the rotary/oscillatory motion is then briefly entirely or nearly synchronized with the rotary motion of the first input element. This is true regardless of whether the rotary motion or the up-and-down motion involves harmonic or nonharmonic motions. After brief synchronicity, the second input element then rotates back again, and then after a 180? rotation of the first input element it again moves synchronously with the first input element over a certain angular range. These brief phases of synchronous motion between the two input elements can be utilized to switch an indexing pawl or other kind of positive-engagement connecting means, connected to the output element, over from the first input element to the second, or vice versa. If the output element is coupled to the first input element, then the shaft executes its reciprocating motion. Conversely, if the output element is coupled to the second input element, which pivots back and forth by only a limited angle, then the shaft is in its resting phase, in which it executes only a slight oscillatory motion about its top or bottom reversal point. However, it can be shifted out of this oscillatory motion during the brief synchronous phases; the forces of acceleration that occur at the shaft and the gear elements involved, and the resultant loads, are hardly greater than in uninterrupted shaft operation. At the least, no significant abrupt changes in the forces of acceleration occur.

The oscillatory motion of the second input element can be attained by means of a cam drive mechanism which is connected rigidly to the input shaft. However, a cam drive mechanism whose shaft revolves at twice the rpm of the input shaft is preferably used, so that with a single cam disk, both the brief synchronous motion for the top reversal point and the brief synchronous motion for the bottom reversal point can be generated. Alternatively, the oscillatory motion can be generated by electric, hydraulic, or pneumatic drive systems.

As the indexing member, an indexing pawl that revolves with the output element is preferably used, which is to be actuated via at least one and preferably two indexing levers past which it travels. The indexing levers can be directly actuated electrically or pneumatically. However, it is preferable to drive them by a cam drive mechanism via a control coupling. The control coupling can then be actuated with only very slight power levels, and on the other hand, sufficiently strong forces are generated to move the indexing levers. The indexing position may be controlled via fixed control magnets, for instance, and may be formed by a selector prong that is driven to oscillate. The result is a control assembly for the coupling system that responds precisely and can be triggered with little energy.

In an alternative embodiment, the two input elements of the cam disk are formed by cam disks, both of which rotate synchronously with the input shaft and are driven by it. The output element of the coupling system here forms a cam follower, which can be brought alternatively into engagement with one cam disk or the other. The cam follower generates an oscillating motion and is not only part of the coupling system but at the same time is part of a gear system for generating the reciprocating motion from the rotary motion of the input shaft. The switchover of the cam follower by the pickup from one cam disk to the other is done at a rotary position of the cam disks in which their arcs match, so that the motion, picked up here from the one cam disk, is synchronized with the motion picked up from the other cam disk. One of the two cam disks may be embodied such that it generates the motion required for shedding, while the other cam disk is embodied as a reversing point disk and generates the oscillating reversal position motion. As such, it has short synchronized arcs serving solely to take over the cam follower element, and otherwise, it has a profile of the kind that does not generate any shedding motion at the heddle shaft, but only generates the reversal position oscillation. In the simplest case, it is a disk with twice the circumferential oscillation and a lesser radial stroke. Two or more cam disks with different work profiles may also be provided. reversal position disks which generate the oscillating reversal position motion at the cam follower may be disposed between each of these cam disks. Thus it is possible to switch over between cam disks and neutral disks, so that the cam follower performing the pickup either, upon engagement with the cam disk that has the work profile, generates a transitional motion from one reversal position to the other, or, upon pickup of the reversal position disk, a departure motion that oscillates with reduced amplitude about the reversal position or out of the reversal position.

It is furthermore possible to assign each set of disks its own cam follower, and to couple the cam followers selectively with an output shaft. The cam disks then form the input elements of the corresponding cam followers, while the output element of the coupling system is connected to a rod linkage that actuates the heddle shaft.

With this kind of coupling system as well, the drive system of a heddle shaft can be switched on and off without slowing down or shutting off the rotary drive mechanism of the input shaft. Overall, a harmonic or nearly harmonic motion of the heddle shaft is generated not only during weaving, but also upon switching the heddle shaft on and off. This creates the preconditions for high weaving speeds, with only little stress on the machine components involved.

Further details of preferred embodiments of the invention will become apparent from the drawing or the description as well as the claims.

BRIEF DESCRIPTION OF THE DRAWINGS

In the drawing, exemplary embodiments of the invention are shown.

DETAILED DESCRIPTION OF THE INVENTION

Figure 1:
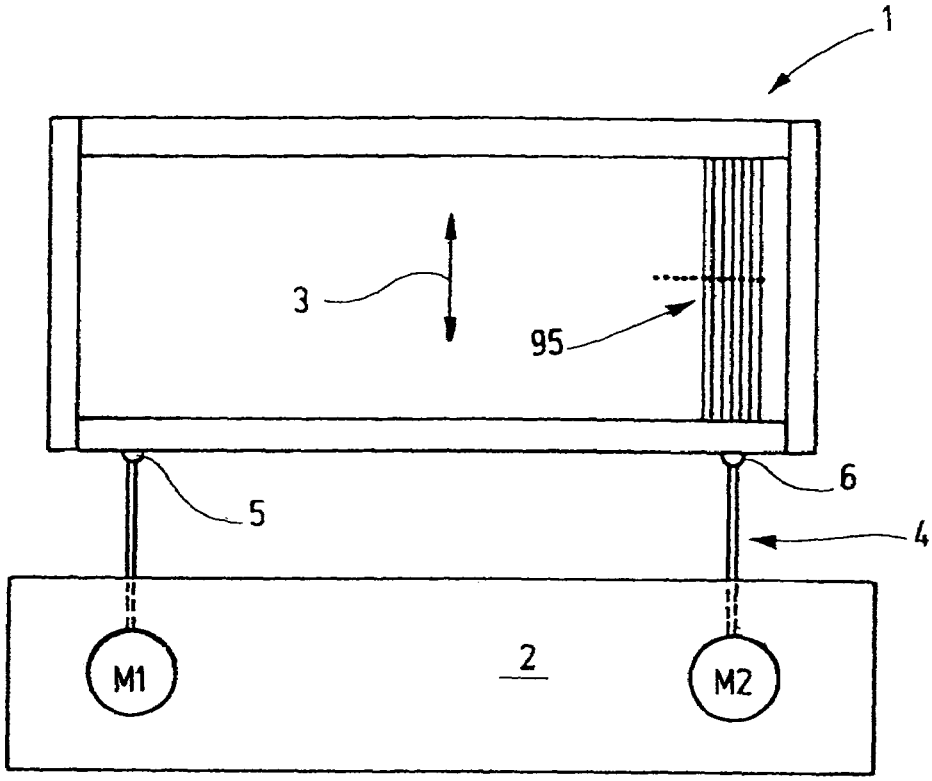
FIG. 1 is a schematic view of a heddle shaft with a shaft drive system.

In FIG. 1, a heddle shaft 1 with an associated shaft drive system 2 is shown. The heddle shaft 1 is formed by a frame which is provided with heddles 95 and which is moved up and down during operation, as indicated by an arrow 3. A rod linkage 4 is used for driving purposes; it is attached to the heddle shaft 1 at two or more points 5, 6 and forms the power takeoff mechanism of the shaft drive system 2. The shaft drive system 2 includes one or more drive sources, for instance in the form of motors M1, M2. These motors are for instance electric servomotors, which are connected to the rod linkage 4 via a spindle lifting gear, a belt gear, or some other gear that converts the rotary motion of the motors into a linear motion. Alternatively, linear motors, linear stepping motors, or the like may be used. In some cases, a single motor suffices, while in others, two or more motors are required.

Figure 2:
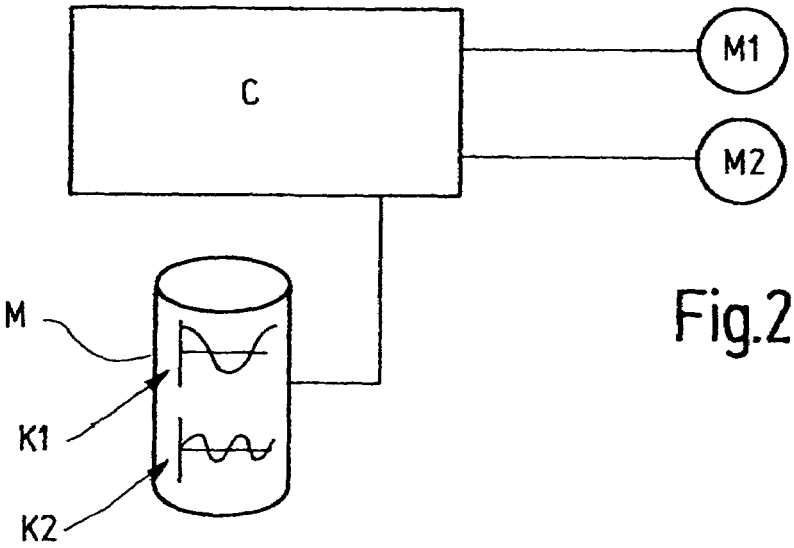
FIG. 2 is a schematic view of the shaft drive system of FIG. 1
Figure 3:
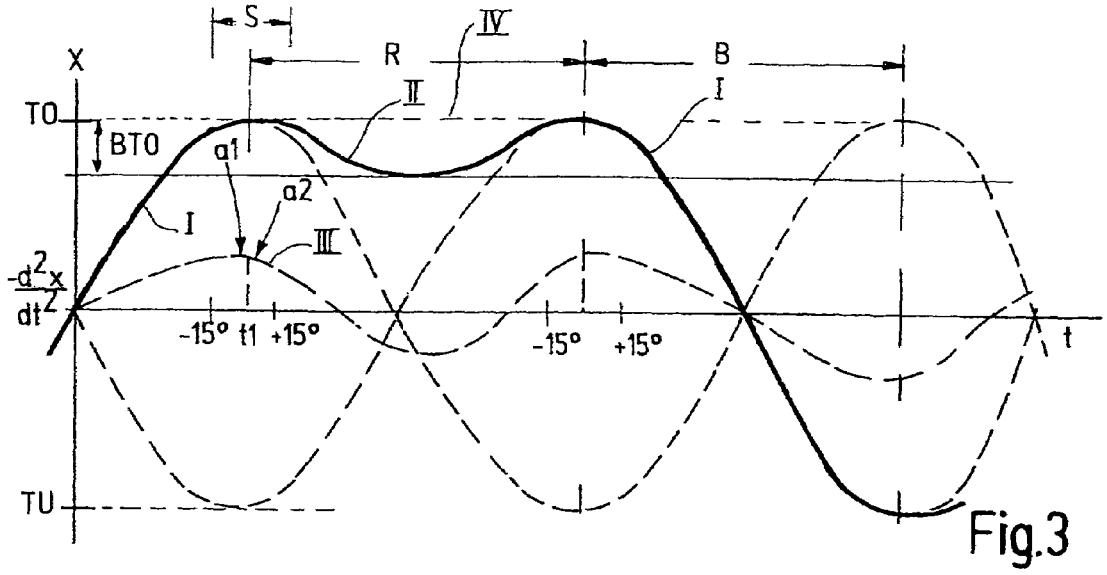
FIGS. 3–5 are graphs showing courses over time of the shaft motion and the shaft acceleration, in different shaft motion courses in different phases of motion.

The motors M1, M2 are controlled by a control unit C, based on a microcontroller, for instance, that is connected to a memory unit M. The control unit C triggers the motors M1, M2 such that the heddle shaft 1 is moved appropriately up and down for shedding. This can be done for instance on the basis of two or more curves K1, K2 stored in the memory unit M; the first curve K1 predetermines the motion of the heddle shaft 1 between its reversal positions, while the second curve K2 predetermines a motion of the heddle shaft 1 within its reversal positions. In detail, the motion of the heddle shaft 1 is effected as follows:

In FIG. 3, the shaft motion is plotted over the time t on the basis of the X coordinate, in the direction of the arrow 3 in FIG. 1, of the heddle shaft 1. The course of the motion is defined by a curve I; the shaft motion can obey a sinusoidal function, as an example. As soon as the shaft has reached its top reversal position TO, in which in terms of weaving operation it could intrinsically stay, however, the curve I of the motion changes over to an oscillatory motion of reduced amplitude and reduced acceleration. This is marked by a curve segment II. The special feature of this curve segment is that in angular regions of ±15?, for instance, around the top reversal point TO, this curve segment follows sinusoidal oscillation shown in FIG. 3 without technically significant deviation. The special identifying trait of the motion impressed on the motors M1, M2 by the control unit C is thus that the heddle shaft 1 does not rest at the top reversal point TO but instead executes an oscillation within a reversal point region BTO. The effect of this provision can be seen from curve III, plotted in dashed lines in the same graph, which illustrates the downward-oriented acceleration, which is therefore preceded by a negative sign, of the heddle shaft 1. If the motion of the heddle shaft 1 initially follows a sinusoidal motion, this shaft acceleration is likewise a sinusoidal function. Within the region of the apex at the top, when the top reversal point TO is reached, the control unit C now changes over from curve I to curve II (FIG. 2). This latter curve virtually takes the form of a harmonic function, so that once again the form of the heddle shaft acceleration is similar to a harmonic function. The motion of the heddle shaft 1 in its top dead center region TO, described by curve segment II or curve II, is defined such that the acceleration A2 that occurs at the top reversal point TO matches the acceleration A1 with which the heddle shaft 1 arrives at the top reversal point TO.

For clarification of the usefulness of the reversal point oscillation a the top or bottom reversal point, see FIG. 3, in which a curve segment IV in dot-dash lines connects the upper apex points of the shaft motion to one another. If the heddle shaft 1, after reaching its top reversal point TO, were to follow this curve course IV, then at time T1 the acceleration, which just then is still at the value A1, would drop suddenly to 0. The resultant peak in acceleration generates loads on the heddle shaft 1 and the heddle, as well as all the gear parts involved, that can lead to shaft and heddle breakage. Such loads are minimized or at least limited by the pendulum motions, because they keep the accelerations minimal.

Figure 4:
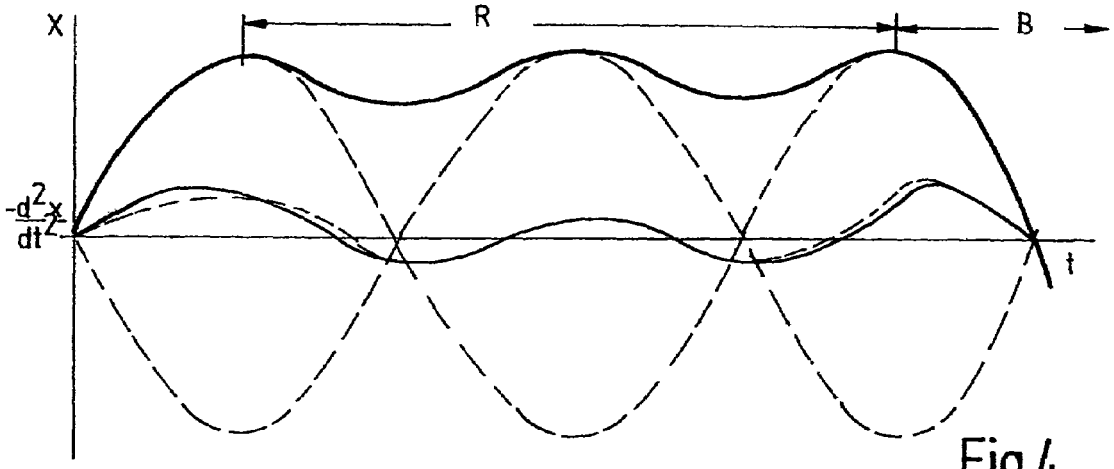

FIG. 4 shows that the reversal point oscillation can be maintained over a plurality of cycles. The resting phase R that occurs between the first and last apexes can extend over one, two, or more cycles of the fundamental oscillation, shown in dashed lines, of the shaft motion. The term "fundamental oscillation" is understood to be a harmonic function with which the heddle shaft 1 is transferred from its bottom reversal point TU to its top reversal point TO. This last takes place during its motion phases B.

Figure 5:
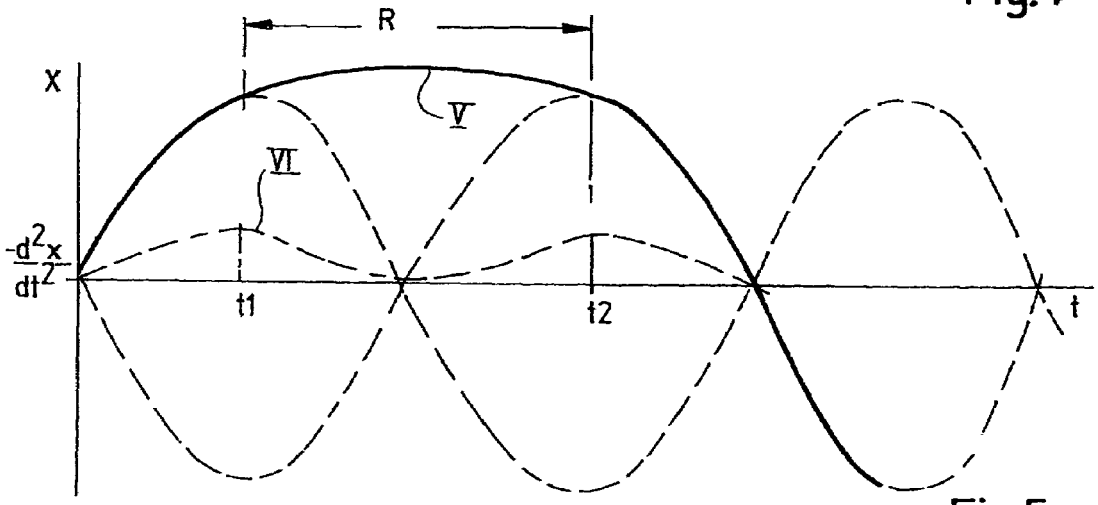
Figure 6:
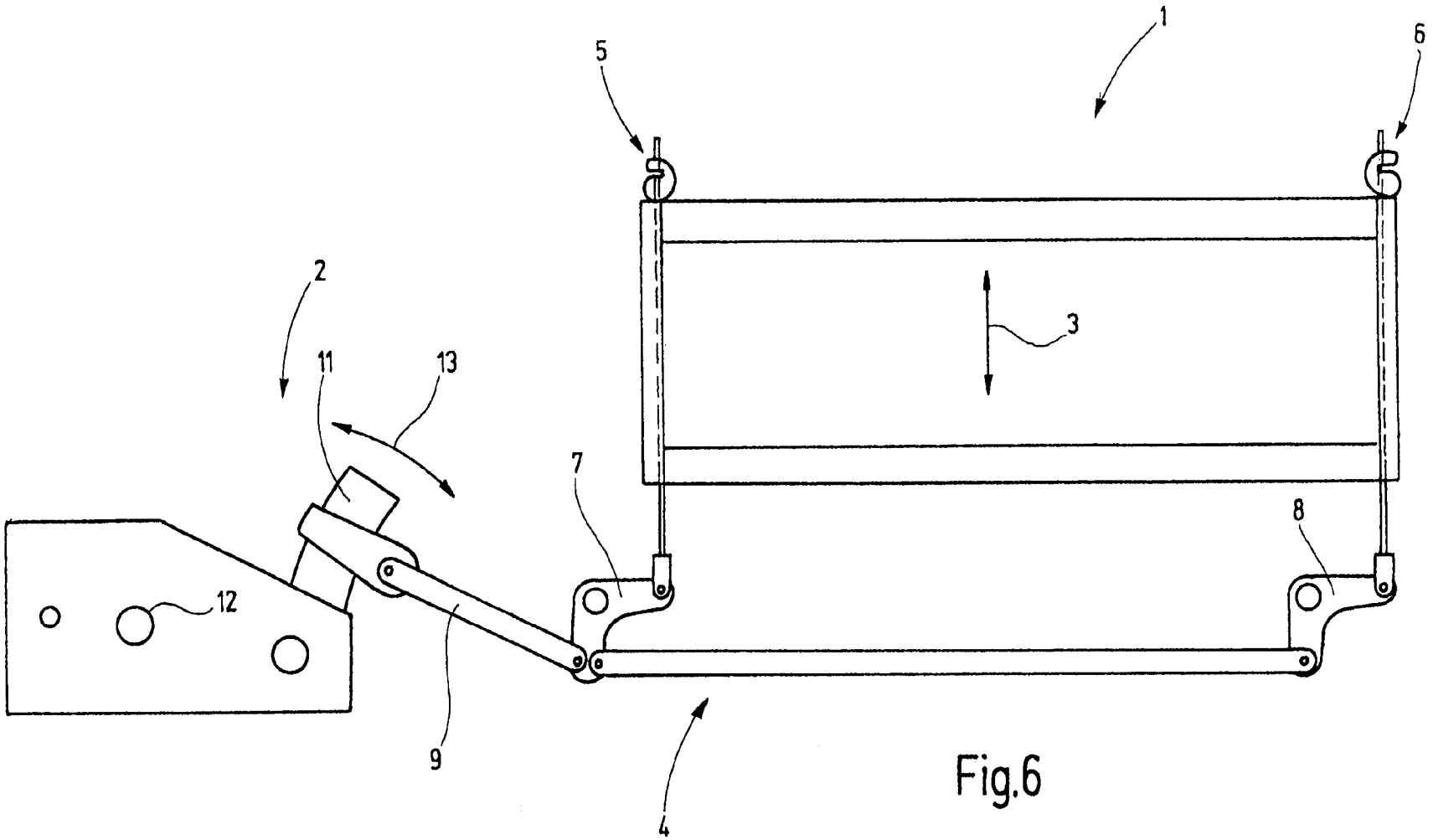
FIG. 6 is a schematic view of a heddle shaft with a mechanical shaft drive system.

FIG. 5 shows a modified realization of the concept described above, namely impressing a motion of slight amplitude upon the heddle shaft 1 during its resting phase R, with the motion remaining within the top reversal point region BTO, or correspondingly within a lower reversal point region. Once again, the apexes of the fundamental oscillation, shown in dashed lines, of the heddle shaft 1 which serves to effect a transfer from one reversal point to the other are marked by a curve segment V, whose second derivation over time, at the times t1, t2 that mark the apex points of the fundamental oscillation, has the same acceleration value as the fundamental oscillation. Thus the acceleration of the heddle shaft 1 is infinitely variable or constant, as the curve segment VI illustrates. However, curve courses as shown in FIG. 3 or FIG. 4 are preferred, because of their technical advantages in weaving.

The aforementioned motions of the heddle shaft 1 in the phases of motion B and the resting phases R may also be attained with a mechanical shaft drive system 2 of the kind shown in FIGS. 6–10. The rod linkage 4 shown in FIG. 6 includes bell crank levers 7, 8, which derive the shaft motion from the motion of a tension and pressure bar 9 and to that end are connected on the one hand to the heddle shaft 1 and on the other, directly or indirectly, to the tension and pressure bar 9. The tension and pressure bar is connected to the shaft drive system 2, which for that purpose has a sword 11, which follows a pivoting motion. From the uniform rotary motion of an input shaft 12, the shaft drive system 2 generates the reciprocating motion represented in FIG. 6 by an arrow 13; at the heddle shaft 1, this motion tax the form of a largely harmonic oscillation motion.

Figure 7:
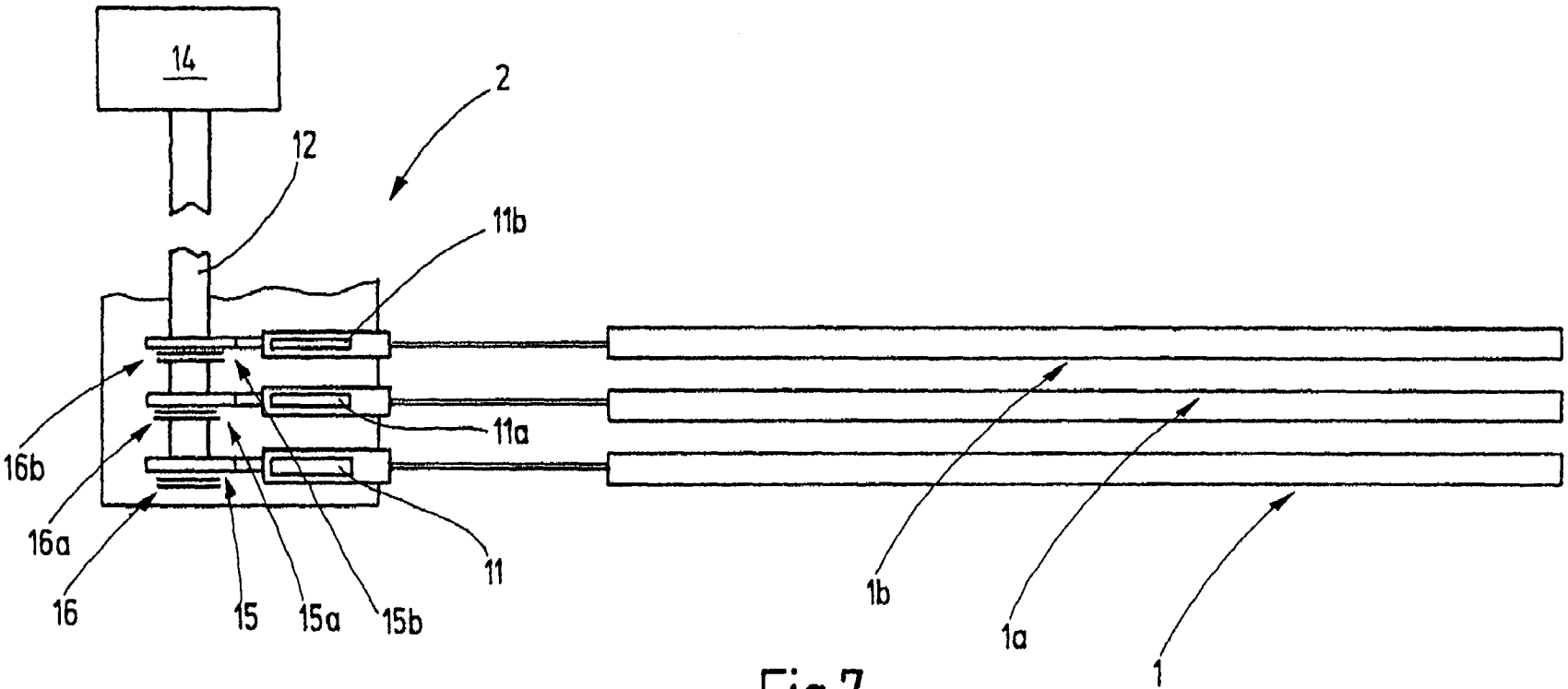
FIG. 7 is a plan view of heddle shafts and an associated shaft drive system of FIG. 1.

As FIG. 7 shows, a plurality of heddle shafts 1, 1*a*, 1*b* may be spaced closely together, one after the other and are driven by the same shaft drive system and thus the same input shaft 12. This input shaft is connected to a rotary drive mechanism 14, which is formed by a servomotor, other kind of electric motor, or power takeoff shaft of a central drive mechanism that drives further components of the power loom.

For each heddle shaft 1, 1*a*, 1*b*, the shaft drive system 2 (FIG. 7) includes one gear system 15 (15*a*, 15*b*) for converting the rotary motion of the input shaft 12 into the reciprocating motion of the respect lever 11 (11*a*, 11*b*) on the output side, as well as a coupling system 16 (16*a*, 16*b*), by way of which the gear system 15 can be selectively connected to and disconnected from the input shaft 12. The coupling system 16 and the gear system 15 are shown schematically in FIGS. 8 and 9. The coupling system serves to control the motion of the heddle shaft and in this respect is the control unit C, which in this case is embodied mechanically. Its construction (FIG. 9) is as follows:

The gear system 15 is formed by an eccentric element 17, which via a connecting rod 18 drives the lever 11 (FIG. 7) to oscillate. Thus the gear system 15 serves to convert the rotary motion of the eccentric disk 17 into a reciprocating motion. The eccentric element 17 is at the same time the output element of the coupling system 16 (FIG. 7), to which two input elements in the form of a first disk 21 and a second disk 22 belong. Both disks 21 and 22 preferably have the same diameter. However, they may also have different diameters, and in FIG. 9 they are also shown with different diameters, for the sake of clarity in the drawing. The first disk 21 is connected to the input shaft 12 and by way of it to the rotary drive mechanism 14. The second disk 22 is supported rotatably about the same axis of rotation 24 as the first disk 21. However, it is not driven to rotate constantly, but instead is driven to rotate back and forth, or in other words to rotate and oscillate, or swing like a pendulum. This is indicated by arrow 25.

Figure 9:
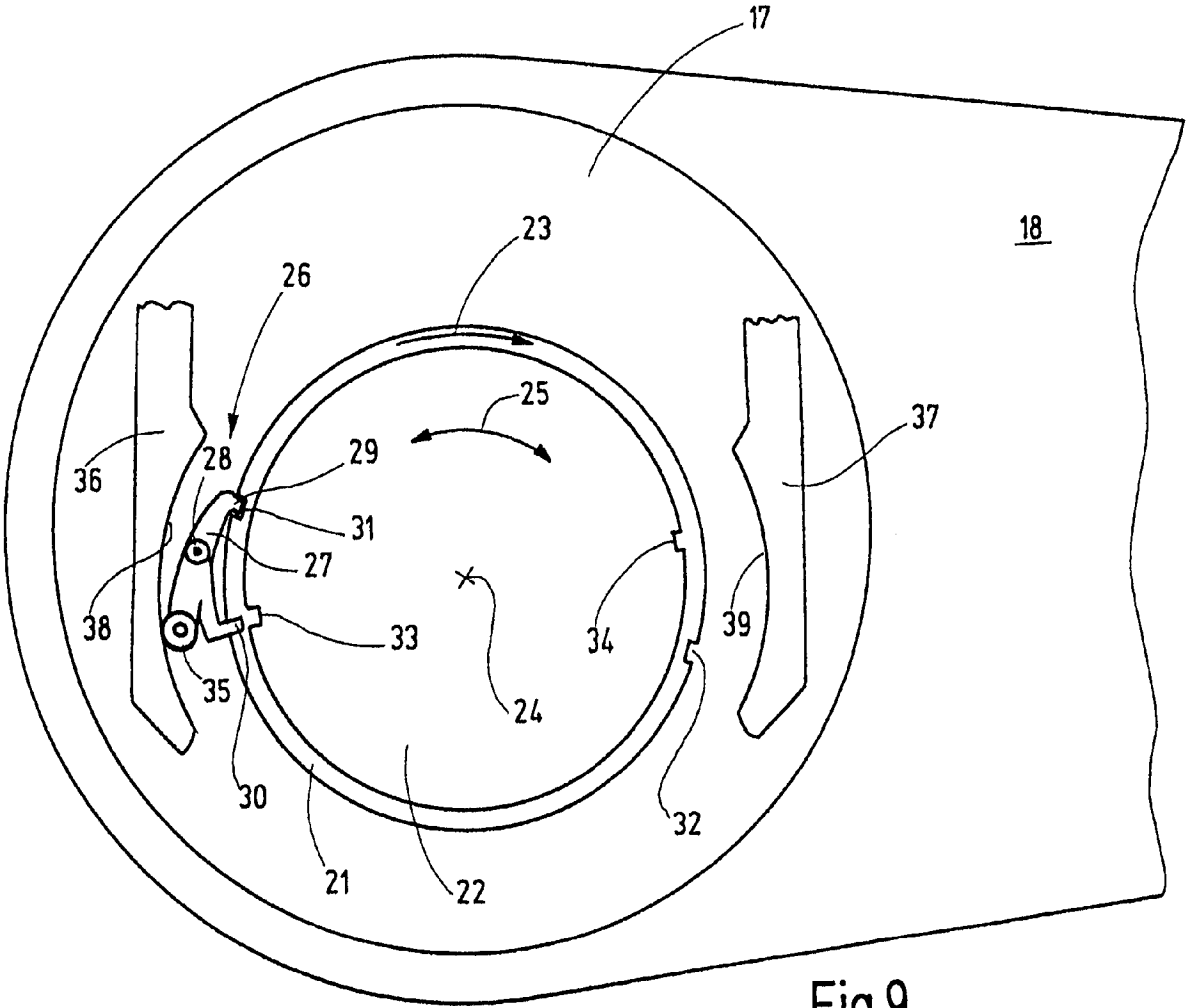
FIG. 9 is a further fragmentary schematic view of the shaft drive system of FIG. 8, on a different scale.
Figure 10:
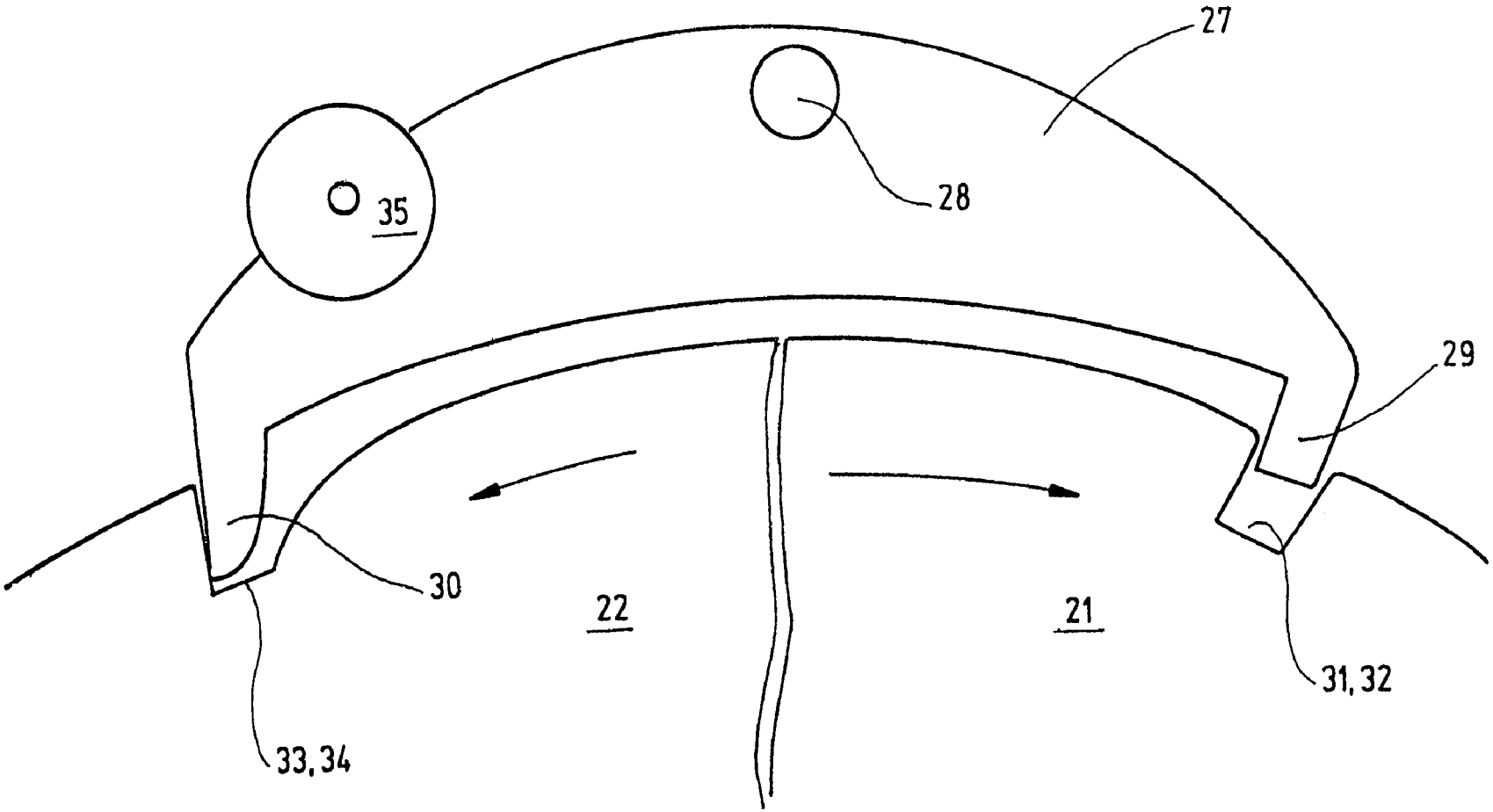
FIG. 10 is a fragmentary view of the shaft drive system of FIGS. 8 and 9.

The coupling system 16 of FIG. 7 further includes an indexing member 26, shown in FIG. 9, in the form of an indexing jack 27, which is supported pivotably about a peg 28 on the eccentric element 17. The indexing jack has a first indexing lug 29 and a second indexing lug 30, the indexing lugs 29, 30 being disposed on different sides of the peg 28. Two detent recesses 31, 32 in the disk 21, facing one another 180? apart, are associated with the indexing lug 29. By means of a spring, not shown, the indexing jack 27 is prestressed with its indexing lug 29 toward the disk 21. On its end adjacent the indexing lug 31, the indexing jack 27 is provided with a control roller 35, which is thus prestressed radially outward relative to the axis of rotation 24 by the spring of the indexing jack 27. The shape of the indexing lugs 29, 30 and of the detent recesses 31–34 can be seen in FIG. 10. Preferably, both the indexing lugs 29, 30 and the detent recesses 31–34 are designed such that snapping into place and unsnapping is as easy as possible. To that end, both the indexing lug 29 and the front and rear flanks of the detent recesses 31, 32 are preferably oriented approximately radially. The leading edge of the detent recesses 31, 32 is lowered somewhat toward the circumference of the circle, to make is easier for the indexing lug 29 to snap into the detent recesses 31, 32. Conversely, both the detent recess 33, 34 and the indexing lug 30 that is associated with the disk 22 that swings back and forth like a pendulum are preferably inclined forward toward the radial. If the detent lug 30 runs along the obliquely positioned rear flank of the detent recess 33, 34, then the detent lug 30 is pulled into the disk 22. The indexing operation is thus accelerated and is executed in a clearly defined way. Conversely, if the detent lug 29 has at least partly moved into the detent recess 31, 32 and the disk 22 is swinging back, then the preferably rounded front flank of that disk presses the detent lug 30 outward and thus brings about the complete switchover of the indexing jack 27.

It may moreover be expedient for the indexing jack 27 to be embodied in two parts, so that the arm that bears the indexing lug 29 and the arm that bears the indexing lug 30 can rotate about the peg 28 independently of one another. As a result, during the synchronous phase, in which the disks 21, 22 briefly run synchronously, both detent lugs 29, 30 can be snapped into place. The length of time during which both detent lugs 29, 30 are snapped in place may be greater, and in fact must be, because of the spacing of the indexing jack 27 in comparison to the one-piece embodiment. By relief of whichever indexing lug 29, 30 is to be disengaged at the time, this lug can then come free of its detent recess 31, 32 or 33, 34 at the appropriate moment.

Figure 8:
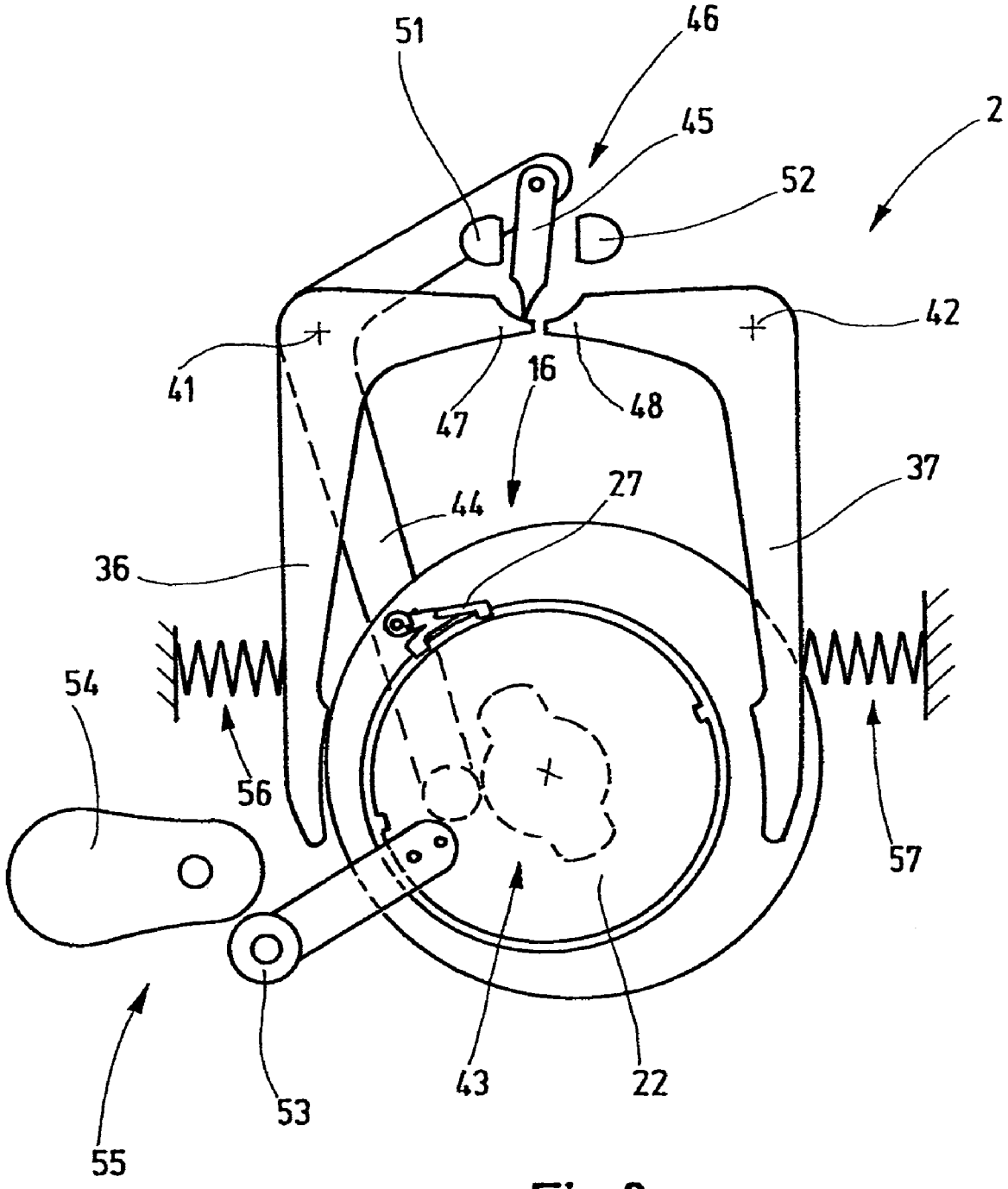
FIG. 8 is a fragmentary schematic view of the shaft drive system of FIG. 1.

The indexing jack 27 is assigned two indexing levers 36, 37 (FIG. 9), which each have one cylindrically curved indexing face 38, 39 serving to actuate the control roller 35. The indexing faces 38, 39 are located approximately concentrically to the axis of rotation 24. The indexing levers 36, 37, as FIG. 8 shows, may be pivoted radially inward and radially outward. The inner pivoting position is selected such that the indexing lug 29 is lifted out of its respective detent recess 31, 32 when the control roller 35 runs along the indexing face 38, 39. Correspondingly, the indexing lug 30 then snaps into the detent recess 33, 34.

For actuating the indexing levers 36, 37, a cam drive mechanism 43 (FIG. 8) is used, which is connected to the input shaft 12 and has for instance two cams. Associated with them is a cam follower lever 44, which is embodied as a bell crank lever and actuates the indexing levers 36, 37 via a selector prong 45 that serves as a control coupling 46. The selector prong 45 is driven to oscillate vertically by the cam follower lever 44 and thus, depending on its pivoted position, actuates either the free end 47 of the indexing lever 36 or the free end 48 of the indexing lever 37, by pressing the applicable end 47, 48 downward for the duration of the deflection of the cam follower lever 44. To enable establishing the pivoted position of the selector prong 45 as desired, control magnets 51, 52 may be disposed on both sides of the selector prong; when the control magnets are supplied with current, they attract the selector prong 45 toward them and keep it in that position.

While the disk 21 is driven to rotate constantly, the disk 22 is, as noted, driven to rotate and oscillate, that is, to swing like a pendulum. To that end a cam follower 53 (FIG. 8) connected to the disk 22 is used, for instance in the form of a roller that is supported on the end of a lever that is rigidly connected to the disk 22. The cam follower 43 is actuated by a cam disk 43, which revolves for instance at twice the rotary speed of the input shaft 12 and has only a single lobe. Thus the disk 22 is imparted a reciprocating oscillating motion twice, for each revolution of the input shaft 12.

The shaft drive system 2 described thus far functions as follows:

First, it is assumed that the eccentric element 17 is to rotate constantly. To that end, the indexing jack 27 must constantly connect the disk 21 with the eccentric element 17.

If this is to be attained, each indexing lever 36 and 37 must deflect outward each time the indexing jack 27, as a consequence of the rotation of the disk 21, moves past the respective indexing lever. To that end, the control magnets 51, 52 are triggered in alternation such that the selector prong 45 presses the end 47 downward when the indexing jack 27 moves past the indexing lever 36, and that the selector prong 45 presses the end 48 downward when the indexing jack 27 moves past the indexing lever 37.

The indexing faces 38, 39 of the indexing levers 36, 37 extend over an angular region that can be considered an indexing region. The cam follower 53, together with the cam disk 54, forms a pendulum drive mechanism 55. This mechanism impresses a rotary/pendulum motion on the disk 22, and this motion is always synchronous with the motion of the disk 21 whenever the indexing jack 27 is traveling through the indexing regions. This phases of motion are characterized in that the cams of the cam drive mechanism 43 force the end of the cam follower lever 44 outward.

During the phase of synchronized travel of the disks 21, 22, the coupling system 16 can be switched over, by providing that the applicable indexing lever 36 or 37 does not deflect outward. As a result (FIG. 9), the indexing lug 29, for instance, is pressed out of the detent recess 31, and the indexing lug 30 is snapped into the detent recess 33. The applicable indexing lever 36 or 37 then remains activated, because the applicable indexing lever 36, 37 is kept in its inner position, for instance by springs (FIG. 8), and is not moved outward by the selector prong 45. In this situation, the eccentric element 17 executes only a pendulum motion back and forth, because it is bound to the disk 22. At the top or bottom reversal point of the heddle shaft, this reciprocating oscillation forth by a few degrees, such as 10?, causes only a slight up-and-down motion of the heddle shaft, by at most only a few millimeters. This is no hindrance to the shedding and weaving process. However, it does make a synchronized re-activation possible, because only the indexing lever 36, 37 at which the indexing jack 27 is stopped is pivoted outward. The cam drive mechanism 43 causes this to happen at the moment of synchronization of the two disks 21, 22, and as a result the eccentric element 17 is started up again gently, without jerking.

Because of the interplay, described above, of the coupling system 16, the heddle shaft 1 is imparted the course of motion shown in FIG. 3 or FIG. 4. At each apex of the fundamental oscillation shown in dashed likes, a switchover is made between resting phases and phases of motion. The eccentric element follows either the disk 21 that rotates continuously (phase of motion), or the disk 22 that swings like a pendulum (resting phase). Correspondingly, either the sinusoidal adjusting motion takes place from TU to TO or from TO to TU (motion phase), or the resting phase R, in which the pendulum motion represented by curve segment II takes place. The switchover is effected during a synchronous phase S (−15? to +15? about the apex of the curve of motion in motion phase B), in which the oscillations of the motion phase B and the resting phase R are sufficiently synchronous.

Figure 11:
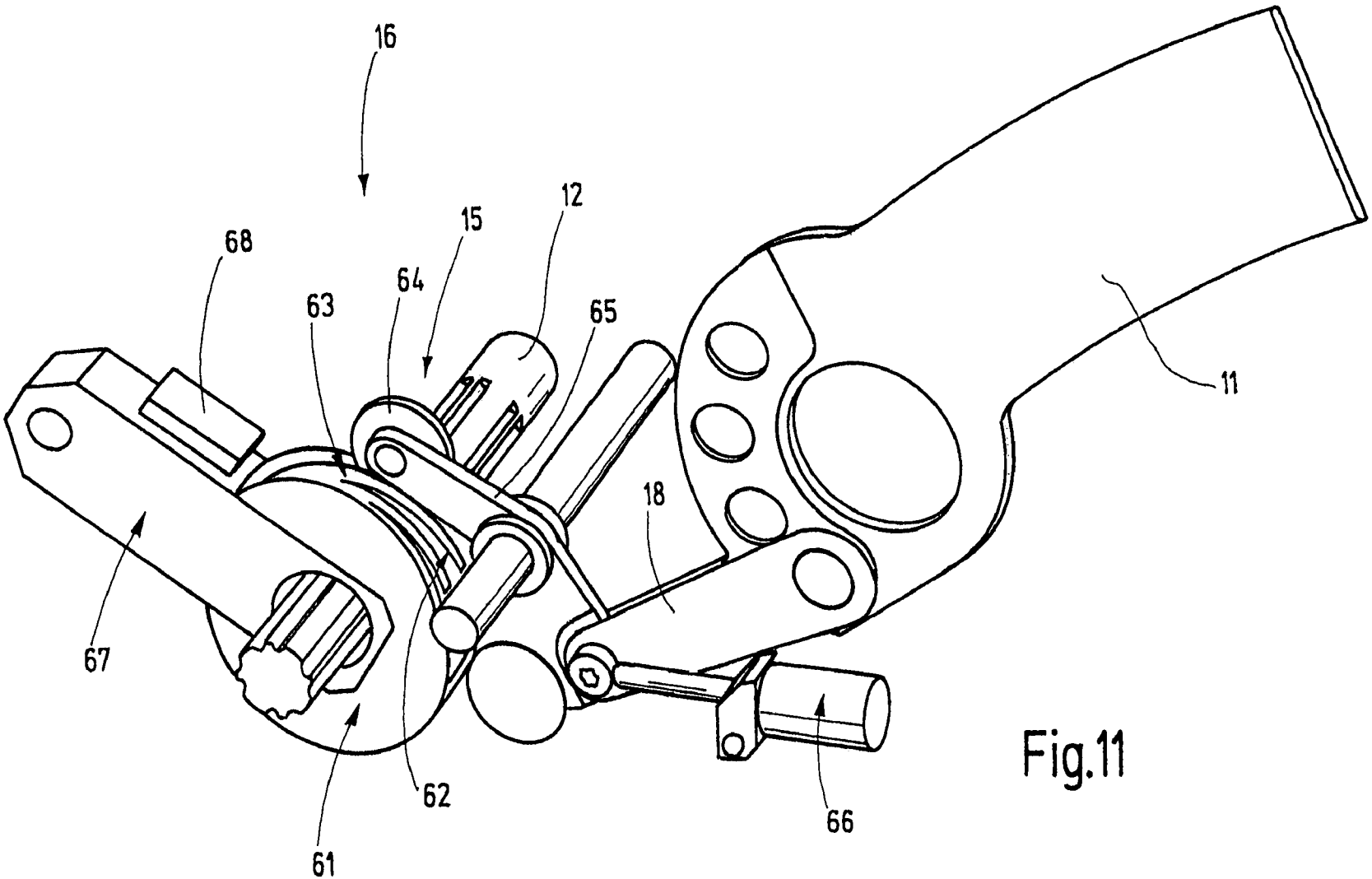
FIG. 11 is a schematic view in perspective of a modified embodiment of a shaft drive system with indexable cam disks.

A modified embodiment of the shaft drive system 2 is illustrated in FIG. 11. Here the input shaft 12 is provided with profile toothing and has a disk packet comprising a plurality of cam disks 61, 62, 63. The cam disks 61, 62, 63 form the input elements of the coupling system 16. The output element is formed here by a cam follower element, which proves the outer circumference of one of the cam disks 61, 62, 63. This purpose is served by a roller 64, which is rotatably supported on one end of a jack 65. Thus the roller is both the output element of the coupling system 16 on the one hand and the gear system 15 for converting the rotary motion of the input shaft 12 into a reciprocating motion. The other end of the jack 65 is connected via the connecting rod 18 to the lever 11, in order to impart a pivoting motion to the lever. A fluid cylinder 66 can furthermore serve to prestress the roller 64 continuously against the cam disks 61, 62, 63.

The cam disks 61, 62, 63 are supported axially displaceably as a packet on the profiled input shaft 12. For the displacement, a control fork 67 and a linear actuator 68, the latter shown only schematically and associated with the control fork, are used.

Figure 12:
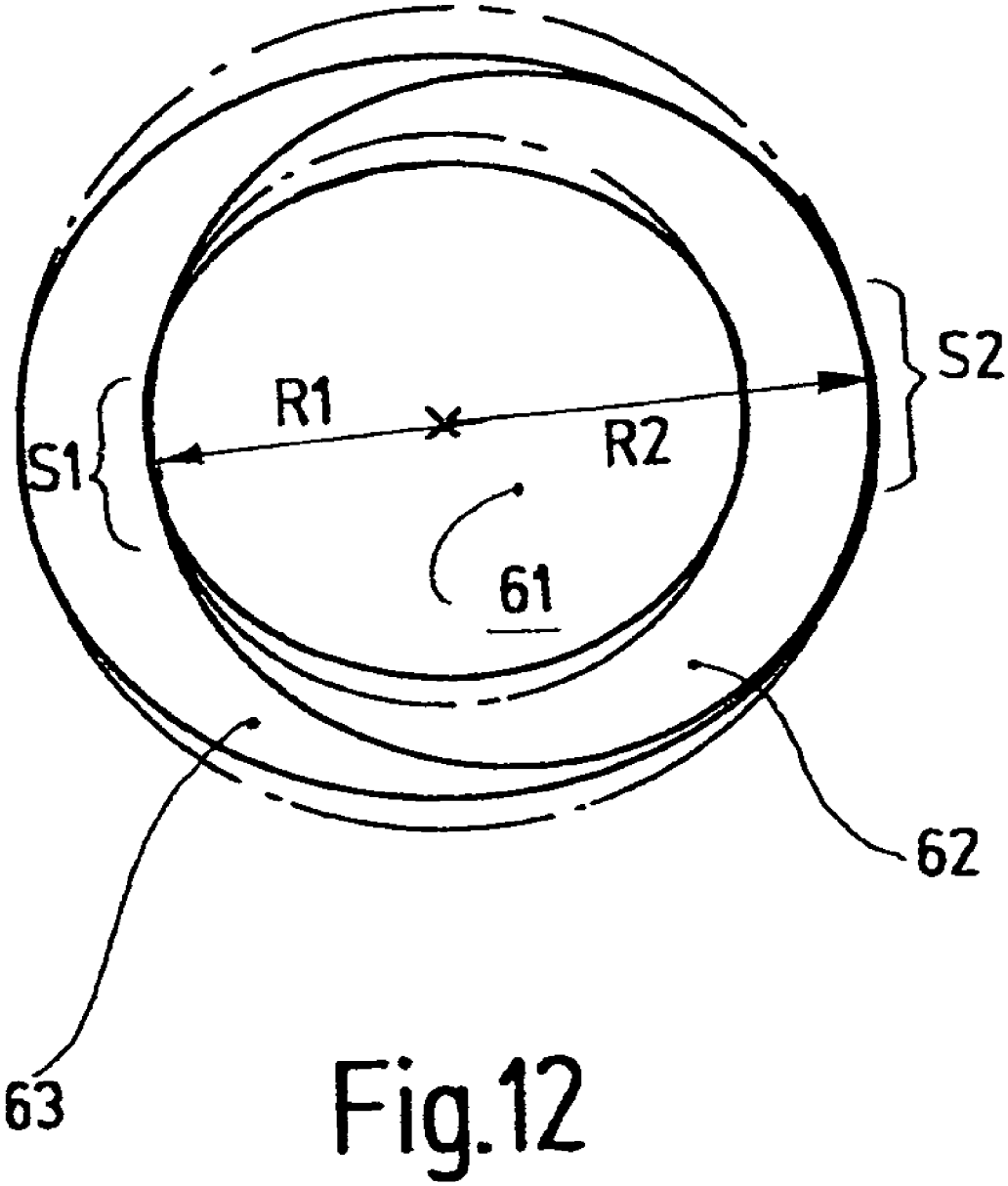
FIG. 12 is a schematic view of the shaft drive system with cam disks.

The cam disks 61, 62, 63, as can be seen for instance from FIG. 12, have different circumferential profiles. For instance, the cam disks 61 and 63 may be embodied as neutral disks, which predetermine the reversal point oscillation at the top and bottom reversal points. If they are active, or in other words if the roller 64 is rolling along their circumference, then the jack 65 executes a pivoting motion, so that the heddle shaft oscillates about its reversal point, for instance at twice the frequency in proportion to the fundamental oscillation (region R in FIG. 3). At least one of the adjacent disks 61, 62, 63 has an outer circumference that serves as a work profile. In the present exemplary embodiment, this is the disk 62 located between the disks 61, 63. It has a work profile which extends from an inner minimum diameter R1 to a maximum diameter R2 and back again. If the roller 64 follows its profile, the shaft executes a work motion (region B in FIG. 3). In respective relatively small synchronized angular regions S1, S2, the circumferential profile matches the profile of the respective cam disk 61 or 63. The cam disk 61 is embodied as a neutral disk, which causes the heddle shaft to oscillate at a reversal point if the roller 64 is running over its circumference. The cam disk 63, conversely, causes the heddle shaft to oscillate in the other reversal point when the roller is running along it. In the synchronized angular regions S1, S2, the packet comprising the cam disks 61, 62, 63 can be axially displaced in order to cause the roller 64 to engage the adjacent cam disk 61 or 63. In this way, within the synchronized regions S1, S2, the motion of the lever 11 can be switched on and off without jerking. As in the exemplary embodiment described above, the switching of the drive system on and off is again based on the fact that the switchover from one input element to another occurs during a brief phase of synchronous motion. In the exemplary embodiment of FIG. 11, the synchronized motion refers to the radial motion component of the roller 64, while in the exemplary embodiment of FIGS. 6–10 it refers to the rotary motion of the disks 21, 22.

Figure 13:
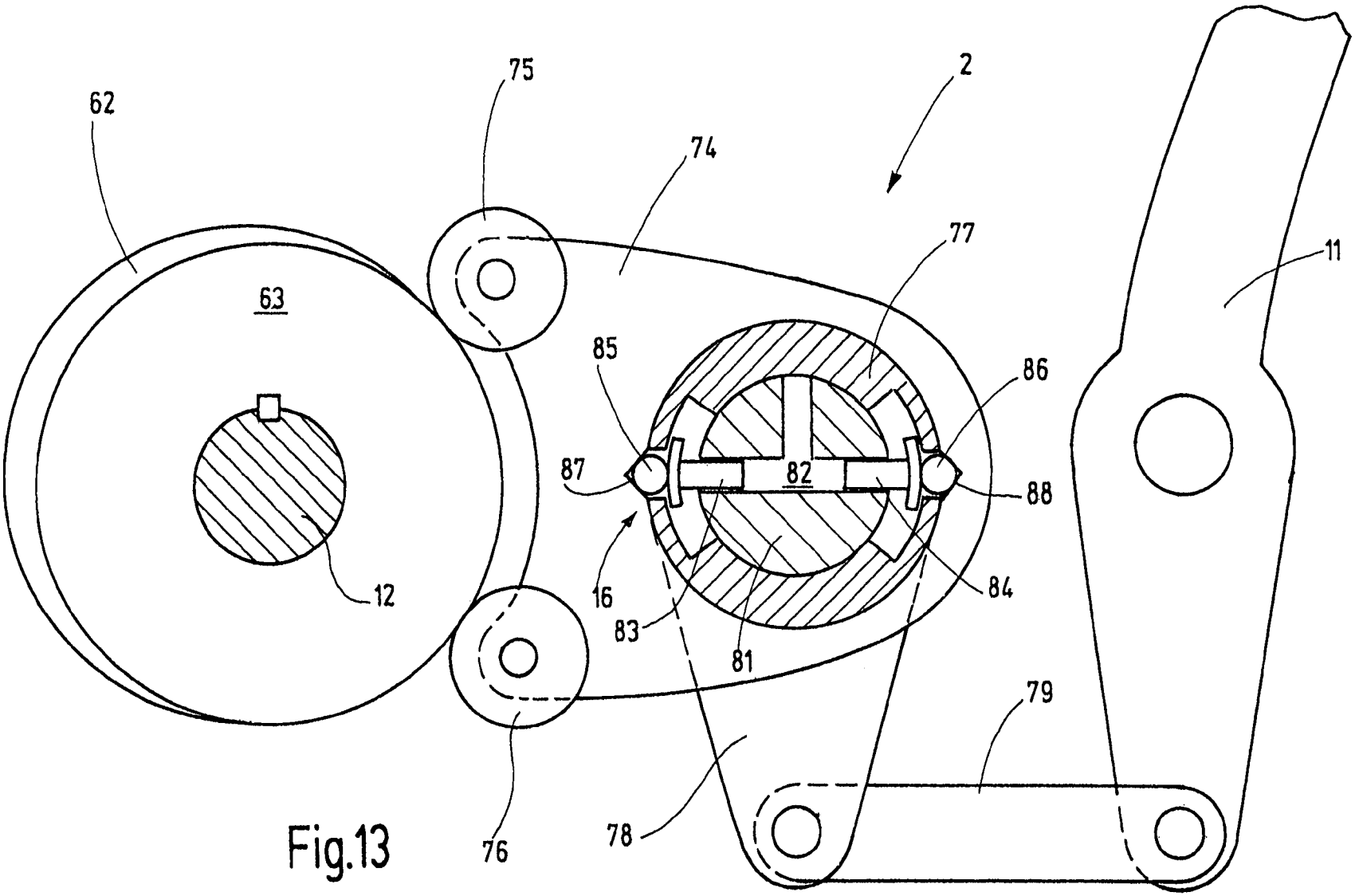
FIG. 13 is a view, partly in section, of a further embodiment of a mechanical shaft drive system.
Figure 14:
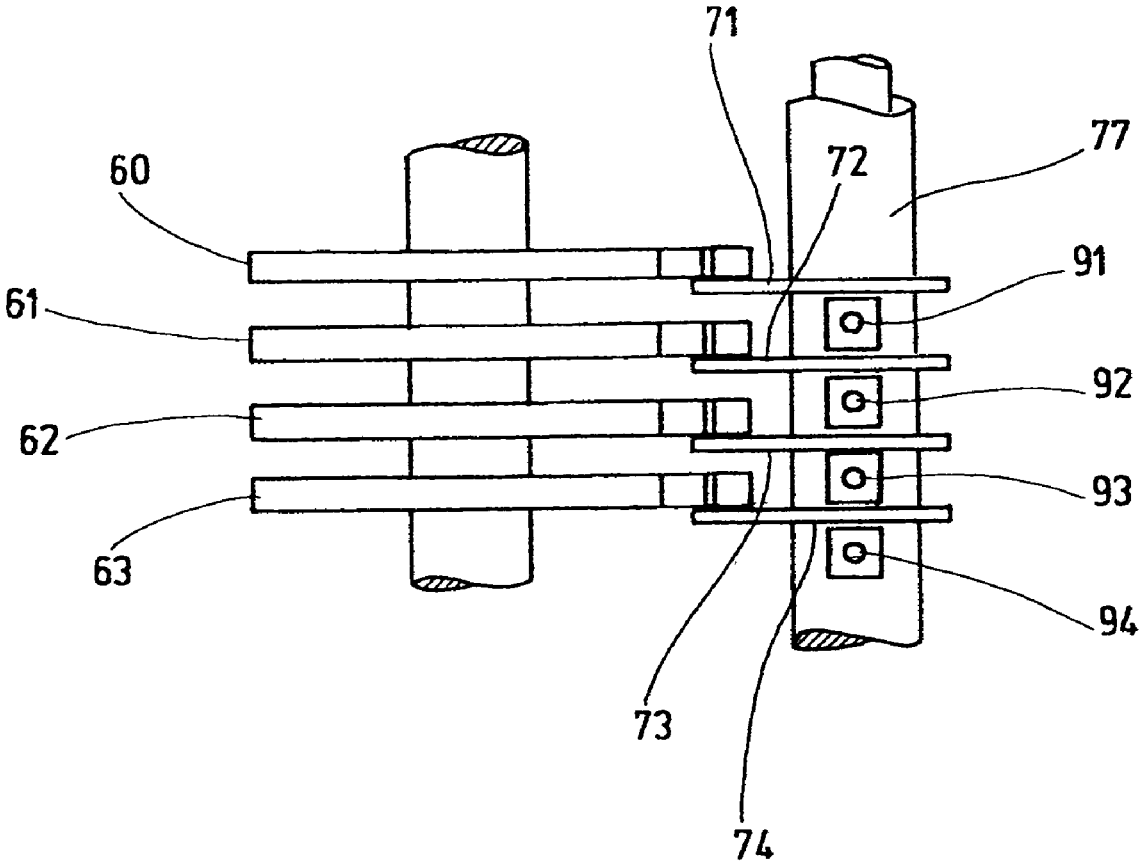
FIG. 14 is a schematic plan view of the shaft drive system of FIG. 13.

In FIGS. 13 and 14, a modified embodiment of the reversible cam drive mechanism is shown that makes do without displaceable cams. As FIG. 14, shows, the cam drive mechanism includes a total of four cam disks 60, 61, 62, 63; the cam disks 60 and 62, for instance, define the fundamental oscillations, shown in dashed lines in FIGS. 3, 4, and 5, for transferring the heddle shaft 1 from one reversal position to the other, while the cam disks 61, 63 define the oscillation in the top or bottom reversal point position. Using four cam disks 60, 61, 62, 63 makes it possible to stagger the up-and-down motion of a heddle shaft 1 chronologically. To that end, once the heddle shaft 1 has been moved to the top reversal point by the cam disk 61, it is shifted by the cam disk 61 into a pendulum motion, from which it is then shifted downward by the cam disk 62 into the bottom reversal point. This is equivalent to a phase offset of 180?. Each cam disk 60–63 is in communication with a respective cam follower 71, 72, 73, 74. FIG. 13 shows the cam follower 74, which probes the outer circumference of the cam disk 63 with two rollers 75, 76.

The cam followers 71, 72, 73, 74 are seated pivotably on a rotatably supported shaft 77, which actuates the sword 11 via a lever 78 and a connecting rod 79. The shaft 77 may be embodied as a hollow shaft and can accommodate the coupling system 16, to which one of the cam followers 71, 72, 73, 74 is connected selectively to the shaft 77 in a manner fixed against relative rotation. In this case, the coupling system 16 includes a cylindrical body 81, which penetrates the shaft 16 and is provided with one radially oriented fluid conduit 82 for each cam follower 71–74. Seated in these conduits are pistons 83, 84, whose flattened, partially cylindrical heads serve to actuate coupling rollers 85, 86. These rollers are seated in radial bores of the hollow shaft 77 and can be pressed outward by the pistons 83, 84. They fit in corresponding recesses 87, 88 in the respective cam follower 71–74. By means of suitably selectively accessible radial connections 91, 92, 93, 94 (FIG. 14), the pistons 83, 84 of each cam follower 71–74 can be separately triggered in a targeted way, so as to couple only one at a time of the cam followers 71–74 to the hollow shaft 77. In this way, a motion profile predetermined by the cam disks 60, 61, 62, 63 can be selected, and the switchover takes place in each case in the synchronous phases as shown in FIGS. 3–5.

A novel shaft gear for harmonic engagement and disengagement of individual heddle shafts and for deriving their motion from the rotary motion of a single input shaft has a coupling system with two input elements 21, 22, 61, 62. While one of the input elements serves to drive the output element of the coupling system 16 permanently, the other input element 22, 62 serves solely to synchronize the output element 17 or 64 briefly with the first input element 21, 61. The switchover takes place in the brief synchronous phases, in selected angular regions that correspond to the top or bottom reversal point of the heddle shaft. For the switchover, such novel shaft drive mechanisms do not require any stoppage of motion for the input shaft or the shaft drive mechanism.

It will be appreciated that the above description of the present invention is susceptible to various modifications, changes and adaptations, and the same are intended to be comprehended within the meaning and range of equivalents of the appended claims.

List of Reference Numerals:

1, 1*a*, 1*b* Heddle shaft
95 Heddle
2 Shaft drive system
3 Arrow
4 Power takeoff mechanism (e.g., rod linkage)
5, 6 Points
7, 8 Bell crank levers
9 Tension and pressure bar
11 Sword
12 Input shaft
13 Arrow
14 Rotary drive mechanism
15 Gear system
16 Coupling system
17 Eccentric element
18 Connecting rod
21, 22 Input element/disk
23 Arrow
24 Axis of rotation
25 Arrow
26 Indexing member
27 Indexing jack
28 Peg
29, 30 Indexing lugs
31, 32, 33, 34 Detent recesses
35 Control roller
36, 37 Indexing lever
38, 39 Indexing face
41, 42 Pivot axis
43 Cam drive mechanism
44 Cam follower lever
45 Selector prong
46 Control coupling
47, 48 End
51, 52 Control magnets
53 Cam follower
54 Cam disk
55 Pendulum drive mechanism
56, 57 Springs
60, 61, 62, 63 Input element/cam disks
64 Roller
65 Jack
66 Fluid cylinder
67 Control fork
68 Actuator
71, 72, 73, 74 Cam followers
75, 76 Rollers
77 Shaft
78 Lever
79 Connecting rod
81 Body
82 Fluid conduit
83, 83 Pistons
85, 86 Coupling rollers
86, 88 Recesses
91, 92, 93, 94 Connections
A1, A2 Acceleration
B Phases of motion
C Control system
K1, K2 Curves
M Memory unit
M1, M2 Motors
T0, TU Reversal position, reversal point
BTO Reversal point region
t Time
R Resting phase
R1, R2 Radii
S Synchronous phase
S1, S2 Synchronous regions
ω1, ω2 Radian frequency

The invention claimed is:

1. A shaft drive system for at least one heddle shaft (1) of a power loom, having at least one power takeoff mechanism (4) which is associated with and connected to the heddle shaft (1) in order to restrain the heddle shaft in resting phases (4) and to impart a motion in phases of motion (B), having a control unit (C, 16) for controlling the current speed of the power takeoff mechanism (4) and thus of the heddle shaft (1), characterized in that the power takeoff mechanism (4) executes a predetermined motion during the resting phases (4) as well.

2. The shaft drive system of claim 1, characterized in that the predetermined motion of the resting phases is determined by the control unit (C, 16).

3. The shaft drive system of claim 1, characterized in that at the onset of a resting phase (R), the power takeoff mechanism (4) has an acceleration which matches its acceleration at the end of the preceding motion phase (B).

4. The shaft drive system of claim 1, characterized in that at the onset of a motion phase (B), the power takeoff mechanism (4) has an acceleration which matches its acceleration at the end of the preceding resting phase (R).

5. The shaft drive system of claim 1, characterized in that the power takeoff mechanism (4) executes an oscillating motion during the resting phases (R).

6. The shaft drive system of claim 1, characterized in that the drive system (2) executes a motion without changing the sign of the acceleration (FIG. 5).

7. The shaft drive system of claim 1, characterized in that the control unit (C), with predetermination of the shaft motion, triggers one or more control motors (M1, M2) in positionally regulated fashion, in order to generate predetermined shaft motions during the resting phases (R).

8. The shaft drive system of claim 5, characterized in that the control motors (M1, M2) are connected rigidly to the heddle shaft (1) on the drive side.

9. The shaft drive system of claim 1, characterized in that the drive system (2) has a coupling system (16), which is disposed between a drive mechanism (14) and a gear system (15) for transmitting the driving motion to the heddle shaft (1), and that the coupling system (16) has not only a first input element (21), connected to the drive mechanism (14) and a second input element (22), but also an output element (17), which is to be connected selectively with the first or the second input element (21, 22), and the drive mechanism (14) imparts a motion with a constant direction of motion to the first input element (21), and a motion with an alternating direction of motion is impressed upon the second input element (22).

10. The shaft drive system of claim 1, characterized in that the drive mechanism (14) is a rotary drive mechanism;

that the first input element (21) is driven to rotate;

that the second input element (22) is driven to rotate back and both; and that the gear system (15) is a device for converting a rotary motion into a reciprocating motion.

11. The shaft drive system of claim 9, characterized in that the first input element (21) and the second input element (22) are at least briefly driven synchronously; and that the switchover is performed during the synchronous phase.

12. The shaft drive system of claim 9, characterized in that the second input element (22) is connected to a pendulum drive mechanism (55), which imparts an oscillating to the second input element (22).

13. The shaft drive system of claim 9, characterized in that the coupling system (16) includes means (36, 37, 46, 44, 43) with an indexing member (26) which is to be connected permanently to the output element (17) and selectively to the first or second input element (21, 22).

14. The shaft drive system of claim 13, characterized in that at indexing positions predetermined by the means (36, 37, 46, 44, 43), the rotary-oscillatory motion of the second input element (22) is synchronous with the rotary motion of the first input element (2); and that the means (36, 37, 46, 44, 43) include at least one indexing lever (36, 37), which is associated with the indexing member (26) in order to engage it or disengage it at at least one predetermined indexing position.

15. The shaft drive system of claim 13, characterized in that the indexing member (26) is connected to the output element (17) and revolves with it.

16. The shaft drive system of claim 15, characterized in that the indexing member (26) is an indexing jack (27), with at least one positive-engagement element (29, 30) for each input element (21, 22).

17. The shaft drive system of claim 15, characterized in that the indexing member (26) comprises two indexing jacks, which are rotatably supported independently around the peg (28) and which, chronologically independently of one another, can plunge with their positive-engagement elements (29, 30) into and emerge from the detent elements (31, 32, 33, 34) of the input elements (21, 22).

18. The shaft drive system of claim 14, characterized in that the indexing lever (36, 37) is connected to a cam drive mechanism (43) via a control coupling (46); that the control coupling (46) has a selector prong (45), which is supported displaceably between at least two positions, in order to activate and deactivate the actuation of the indexing lever (36, 37) by the cam drive mechanism (43); and that the selector prong (45) is movable by at least one control magnet (51, 52).

19. The shaft drive system of claim 1, characterized in that the drive system (2) has a coupling system (16), which is disposed between a drive mechanism (14) and a gear system (15) for transmitting the driving motion to the heddle shaft (1), and that the coupling system (16) has not only a first input element (61, 63), connected to the drive mechanism (14) and a second input element (60, 62), but also an output element (64), which is to be connected selectively with the first or the second input element (61, 62), and the first input element and the second input element are each cam disks (60, 61, 62, 63); and that the output element is a cam follower (64), which can be selectively shifted into engagement with one of the input elements (60, 61, 62, 63).

20. The shaft drive system of claim 19, characterized in that the first input element and the second input element are each cam followers (71, 72, 73, 74) that are in contact with different cam disks (60, 61, 62, 63); and that the output element is a shaft (77), which can be selectively shifted into driving communication with one of the cam followers (71, 72, 73, 74).

21. The shaft drive system of claim 19, characterized in that the cam disks (60, 61, 62, 63) each have on their circumference a circumferential surface with a matching profile section of non-constant radius, as a switchover region.

* * * * *